US010144240B2

(12) United States Patent
Pantaleoni

(10) Patent No.: US 10,144,240 B2
(45) Date of Patent: Dec. 4, 2018

(54) PROCESS AND APPARATUS FOR THE PRODUCTION OF MULTIPAGE INFORMATION LEAFLETS AND THE INFORMATION LEAFLET OBTAINED IN THIS WAY

(71) Applicant: GRAFICHE PIZZI S.R.L., Settimo Milanese (IT)

(72) Inventor: Paola Pantaleoni, Settimo Milanese (Milan) (IT)

(73) Assignee: GRAFICHE PIZZI S.R.L., Settimo Milanese (Milan) (IT)

( * ) Notice: Subject to any disclaimer, the term of this patent is extended or adjusted under 35 U.S.C. 154(b) by 0 days.

(21) Appl. No.: 15/413,810

(22) Filed: Jan. 24, 2017

(65) Prior Publication Data

US 2018/0207973 A1 Jul. 26, 2018

(51) Int. Cl.

| | |
|---|---|
| ***B42C 19/08*** | (2006.01) |
| ***B42D 15/00*** | (2006.01) |
| ***B42C 9/00*** | (2006.01) |
| ***B42C 19/02*** | (2006.01) |
| ***B65H 45/20*** | (2006.01) |
| ***B65H 35/04*** | (2006.01) |
| ***B65H 35/00*** | (2006.01) |
| ***B41F 13/60*** | (2006.01) |
| ***B41L 43/06*** | (2006.01) |

(52) U.S. Cl.

CPC ..... *B42C 19/08* (2013.01); *B41F 13/60* (2013.01); *B41L 43/06* (2013.01); *B42C 9/0081* (2013.01);

(Continued)

(58) Field of Classification Search

CPC .... B65H 45/20; B65H 35/04; B65H 35/0006; B65H 2301/5113; B65H 2301/5151;

(Continued)

(56) References Cited

U.S. PATENT DOCUMENTS 4,066,251 A * 1/1978 Johnsen ..... B65H 39/16 270/37

6,273,411 B1 8/2001 Vijuk (Continued)

FOREIGN PATENT DOCUMENTS

| | | | | |
|---|---|---|---|---|
| EP | 3025870 A1 * | 6/2016 | ..... | B42C 9/0081 |
| GB | 1 429 868 A | 3/1976 | | |
| WO | 02/40285 A1 | 5/2002 | | |

OTHER PUBLICATIONS

IT Search Report, dated May 26, 2015, from corresponding IT application.

(Continued)

*Primary Examiner* — Leslie A Nicholson, III

(74) *Attorney, Agent, or Firm* — Young & Thompson

(57) ABSTRACT

A process for the production of multipage information leaflets or slips, the information leaflet provided with a booklet structure including two or more pages, the process including in sequence the steps of: loading and feeding of a ream of sheets printed on one or both sides, taking of a single sheet from the ream and gluing along an edge portion of the single sheet, multiple folding of the single sheet on itself along the glued portion to define a folded sheet, cutting of the folded sheet to define the multipage information leaflet with the pages connected one to the other only at a joining area in proximity of an edge, pressing of the information leaflet at the joining area, accumulation and collection of the finished information leaflets and optional rejecting of the leaflets which do not comply with the production specifications.

15 Claims, 4 Drawing Sheets

(52) U.S. Cl.
CPC ..... *B42C 19/02* (2013.01); *B42D 15/008* (2013.01); *B65H 35/0006* (2013.01); *B65H 35/04* (2013.01); *B65H 45/20* (2013.01); *B65H 2301/5113* (2013.01); *B65H 2301/5151* (2013.01)

(58) Field of Classification Search
CPC ..... B42C 19/02; B42C 19/08; B42C 9/0081; B42D 15/008; B41F 13/60; B41L 43/06
USPC ..... 270/39.01, 52.04, 52.17, 52.18; 493/231, 493/264, 451, 453
See application file for complete search history.

(56) References Cited

U.S. PATENT DOCUMENTS 6,290,796 B2 * 9/2001 Furst ..... B42C 3/00 156/211
6,592,056 B2 * 7/2003 Yamakawa ..... B05B 15/0233 239/569
6,656,103 B1 * 12/2003 Neubauer ..... B42D 15/008 493/434
6,712,924 B2 * 3/2004 Silverbrook ..... B41J 3/44 156/277
6,717,286 B2 * 4/2004 Tsuchiya ..... B42C 1/12 270/52.18
6,902,639 B1 * 6/2005 Perelman ..... B29C 53/48 156/203
7,182,723 B2 * 2/2007 Neubauer ..... B42D 15/008 493/434
7,257,937 B2 * 8/2007 Nakagiri ..... B65H 15/02 53/520
8,152,152 B2 * 4/2012 Sakata ..... B43M 5/047 270/52.18
2002/0159862 A1 10/2002 Ertel et al.
2012/0306140 A1 * 12/2012 McIntyre ..... 270/4

OTHER PUBLICATIONS

EP Search Report, dated Feb. 3, 2016, from corresponding EP application.

* cited by examiner

PROCESS AND APPARATUS FOR THE PRODUCTION OF MULTIPAGE INFORMATION LEAFLETS AND THE INFORMATION LEAFLET OBTAINED IN THIS WAY

FIELD OF THE INVENTION

The object of the present invention is a process and apparatus for the production of multipage information leaflets.

BACKGROUND OF THE INVENTION

More particularly the present invention relates to the process and to the apparatus for the production of the information leaflets or slips typically enclosed in the packagings of medicines, cosmetics and/or used in the pharmaceutical sector and, in general, in the area of manuals.

As is known, in particular in the medical and pharmaceutical area, the information leaflet or slip has to be, as a function of the specific laws of the various countries, obligatorily enclosed with the drug whereto it refers and has to contain all the information necessary and useful for the correct use and storage of the same.

More particularly this information leaflet has to contain the description of the product (for example the name of the product, the active ingredient, the excipients, etc.), the intended use, the manner of use, the dosage, counter-indications, the interactions with other products and the unwanted side effects caused, for example, by the interaction with other products/drugs or by an overdose of the drug.

All this and other possible information is, typically, given on a single paper leaflet, printed on one or both sides and folded several times in order to be able to be inserted in the packaging of the product whereto it refers.

However, taking into account the considerable quantity of information present therein and the statutory provisions which impose the use of print characters with dimensions suitable for encouraging greater legibility, pharmaceutical companies tend to produce information leaflets made up of a single sheet of increasingly large dimensions, folded several times over on itself in order to be able to be inserted in the packaging of the reference drug.

These traditional information leaflets or slips, however, have some major disadvantages linked to their dimensions once opened for consultation. In fact, bearing in mind the considerable dimensions of the sheet, they can make reading of all the information difficult and, moreover, are difficult to fold correctly and return into the packaging of the product after consultation.

SUMMARY OF THE INVENTION

In order to avoid these disadvantages information leaflets or slips have been created wherein the information is not contained on a single printed sheet or on one or both sides, but inside comprise two or more joined or bound sheets so as to define a sort of booklet or small handbook.

In this way it is possible to use characters of larger dimensions for an improved legibility and, likewise, insert a larger quantity of information.

The two or more sheets are printed singly, trimmed and, finally, joined one to the other along one edge by means of glue, heat sealing or binding by stitching.

However this type of information leaflet also has some major disadvantages due to the fact that the single sheets are printed separately and subsequently bound. This may entail a mixing of sheets or the presence of blank sheets or of sheets with indications not corresponding to those of the reference drug.

U.S. Pat. No. 6,273,411 discloses a method and apparatus for folding a single sheet of paper into a booklet. The method includes depositing adhesive along a linear path on the single sheet of paper and folding the sheet by making a plurality of folds parallel to a first direction, thereby forming a plurality of interconnected panels. The lateral edges of the panels are cut off so that the panels are no longer interconnected. A fold is made along a line coincident with the linear path to form the booklet.

The object of the present invention is that of obviating the disadvantages stated above. More particularly the object of the present invention is that of providing a process and the relative apparatus for the production of an information leaflet or slip of the booklet type defined by two or more sheets printed on one or both sides and joined one to the other to allow easy reading and consultation by the user, with said information leaflet or slip typically folded on itself for the insertion in the container of the drug or product and such, moreover, as to be able to be easily unfolded for consultation and refolded for reinsertion in the container.

A further object of the present invention is that of providing a process for the production of information leaflets suitable for reducing the possibility of error with reference to the information contained on the sheets or to the printing of the same and, at the same time, increasing the production with a reduction in the cycle times and correlated costs.

A further object of the present invention is that of providing a process for the production of information leaflets apt to ensure the obtaining of a product of excellent quality.

A further object of the present invention is that of making available to users a process and an apparatus for the production of multipage information leaflets or slips apt to ensure a high level of resistance and reliability in time and such, moreover, as to be able to easily and economically produced.

These and other objects are achieved by the process of the invention that has the features of claim 1.

According to the invention a process is provided for the production of multipage information leaflets or slips comprising a sequence of processing steps defined by a loading and feeding of a ream of sheets printed on one or both sides, a taking of a single sheet from said ream and application of glue along a portion of edge of said single sheet, a multiple folding of the single sheet on itself along lines of folding that are parallel one to the other and transversal to the portion provided with glue to define a folded sheet, a cutting of said folded sheet along the opposite transverse edge portions formed by the step of folding to define the multipage information leaflet with the pages connected one to the other only at a joining area defined by the area provided with glue in proximity of an edge, an optional calendering or pressing of the glued portion, an accumulation and collection of finished information leaflets and an optional rejecting of the leaflets which do not comply with the production specifications.

Advantageous embodiments of the invention are disclosed by the dependent claims.

BRIEF DESCRIPTION OF THE DRAWINGS

The constructional and functional features of the apparatus for the production of multipage information leaflets or slips according to the process of the present invention will be made clearer by the following detailed description, in which reference is made to the accompanying drawings which represent a preferred and non-limiting embodiment thereof and in which.

DETAILED DESCRIPTION OF THE INVENTION

Figure 1:
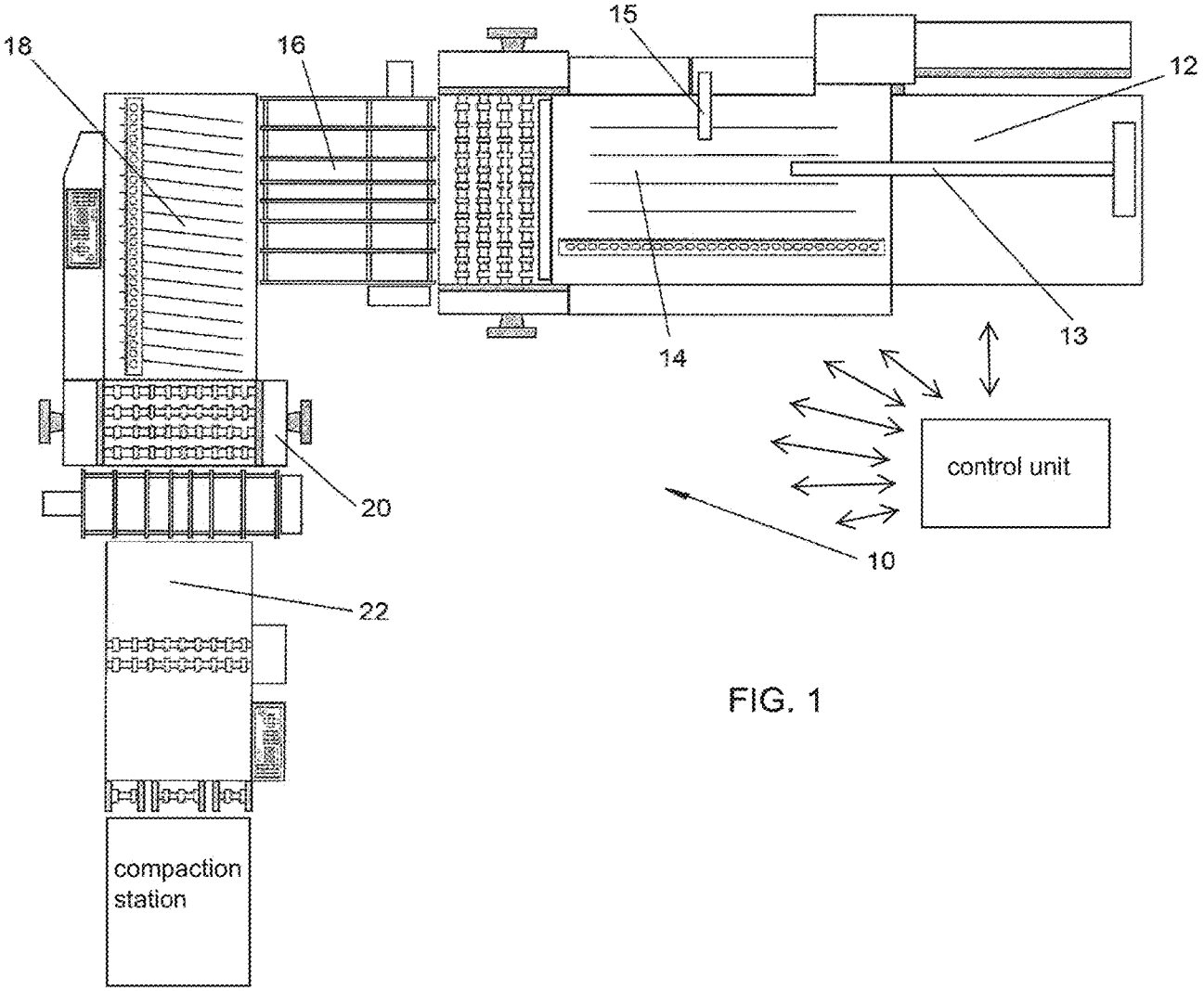
FIG. 1 shows schematically a plan view of the apparatus for the production of multipage information leaflets or slips of the invention.
Figure 7:
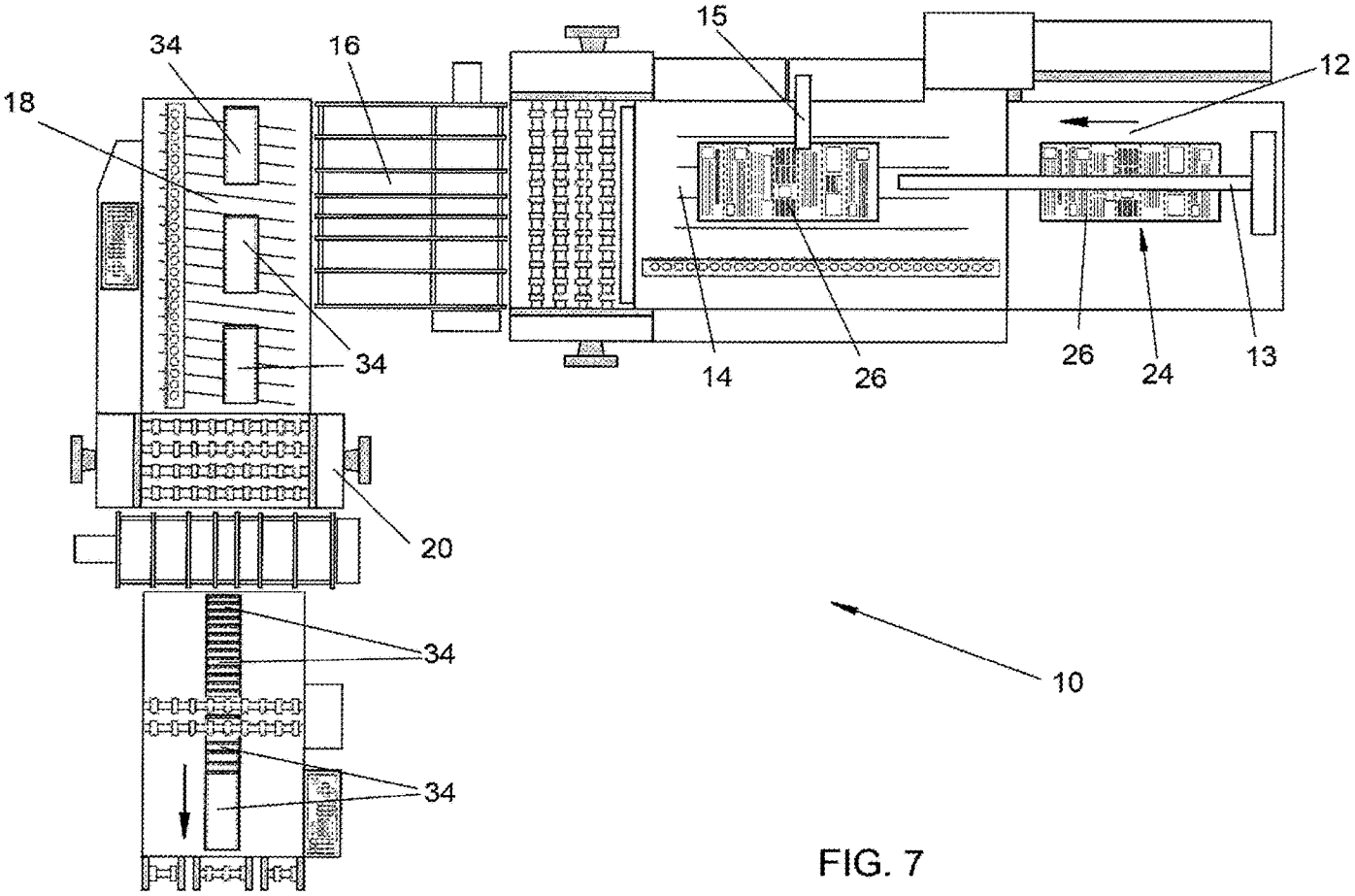
FIG. 7 shows schematically a plan view of the apparatus of the invention which illustrates the process steps of the invention.

Referring to the aforesaid drawings and, in particular, to FIGS. 1 and 7, a description is given here below of the apparatus and process for the production of multipage information leaflets or slips suitable for being enclosed with medical-pharmaceutical or cosmetic products or the like.

This apparatus, denoted overall by 10, comprises a plurality of stations, placed in succession, each of which is apt to move the information leaflet and to operate to produce the same as detailed here below.

More particularly the apparatus comprises a loading and feeding station 12, a gluing station 14, a folding and cutting station 16, a transit or transfer station 18, a pressing station 20 and a finished products accumulation station 22.

These stations are arranged in a linear or angular configuration (as in FIGS. 1 and 7) or of another type as a function of the layout features of the system and of further optional equipment combined with said apparatus and necessary, for example, for the packaging process of the product with which the information leaflet is enclosed.

The loading and feeding station 12 is provided with a sheet feeder device 13 apt to take a single sheet from a block or ream of sheets loaded onto said station and, typically, comprising a pneumatic head for the lifting of a single sheet at a time and a drum to drive the same in the direction of the next station.

The gluing station 14 comprises, tendentially, a gluing head 15 having the function of depositing or spraying, hot or cold, small drops of glue or a strip of glue as explained here below.

The folding and cutting station 16 has the function of folding the sheet according to the production specifications and of cutting the excess and unnecessary portions.

The transit and transfer station 18 has the function of moving the sheets coming from the folding and cutting station to a successive station defined by the pressing station 20 which performs an operation of pressing of the folded sheet (as detailed here below) which, subsequently, is transferred to the accumulation station 22 which collects the finished products which are then stored or transferred to other apparatuses for further processes linked to packaging.

The stations described above are, moreover, provided with sensors, meters and optional video-cameras for the acquisition of the production cycle parameters (number of sheets processed, speed, etc.), for the monitoring of the production cycle (for example for the rejecting of defective or non-compliant products) and of the apparatus (for example for the management of machine down times, blockages, periodical maintenance and the like).

In addition to the above described stations of processing and downstream of the accumulation station 22 which collects the finished products or information leaflets formed, the apparatus of the invention can comprise an optional compacting station (not shown in the drawings) apt to allow the compacting of all the information leaflets accumulated in the accumulation station 22 dividing it into reams of information leaflets which can then be transferred to a warehouse or to a packaging station or to stations of folding and insertion in the packaging of the product with which they have to be enclosed and the like.

The apparatus also comprises a control unit suitable for controlling and managing the sequential and synchronised functioning of the working stations on the basis of signals coming from the sensors.

A control panel, not shown in the drawings, is placed on the apparatus 10 with the function of defining an operator interface with the control unit to allow said operator the visualisation of the processing steps, the control of the production cycle, the variation of the processing parameters as a function of the formats of paper optionally used, etc.

The process for the production of the multipage information leaflet by means of the apparatus 10, described above with reference to its component parts, is detailed here below.

More particularly the process of the invention produces the multipage information leaflet or slip from a single sheet 26, with tendentially rectangular development, whereon is printed, on one or both sides (in FIG. 2 a single sheet printed on only one of the two sides is schematised), all the information which will go to characterise the single pages which can be browsed of the information leaflet to be associated with a specific product.

Figure 2:
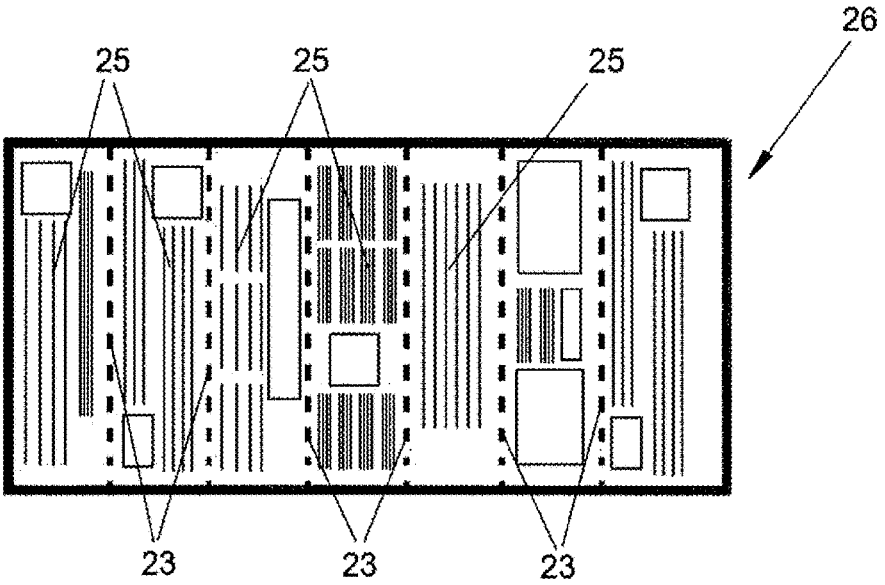
FIGS. 2 to 5 show schematically the sequence of the processing steps for the production of the information leaflet in accordance with the process of the invention.
Figure 3:
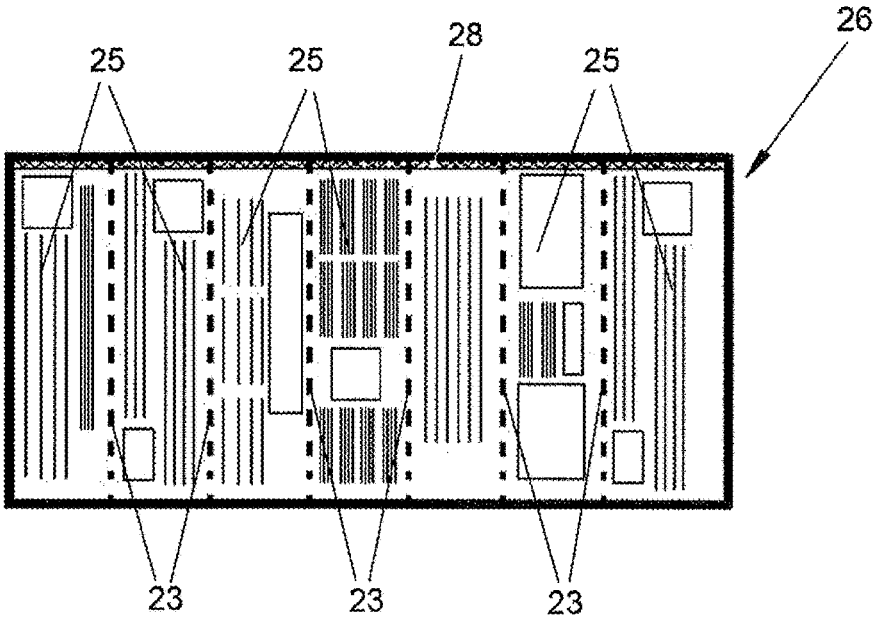

As schematised in FIG. 2 the single sheet 26 comprises a plurality of parallel imaginary lines 23 (denoted by a dotted line in FIGS. 2 to 4), arranged transversely with respect to the direction of longitudinal development of the sheet and apt to define wings or portions 25 defining single pages 27 (FIG. 6) of the information leaflet as described in detail here below.

The single sheets 26 organised in a ream 24 are loaded into the loading and feeding station 12 where the sheet feeder device 13 takes a single sheet 26 (by means of the pneumatic head) and moves it (by means of the drum) in the direction of the successive gluing station 14, where the gluing head 15 deposits or sprays drops of glue or a layer of glue along a zone or band 28 of a side of said single sheet 26 developed along an entire edge of the sheet 26 at its long side.

Alternatively the glue can be deposited or sprayed along an edge at the short side of said sheet 26.

Figure 4:
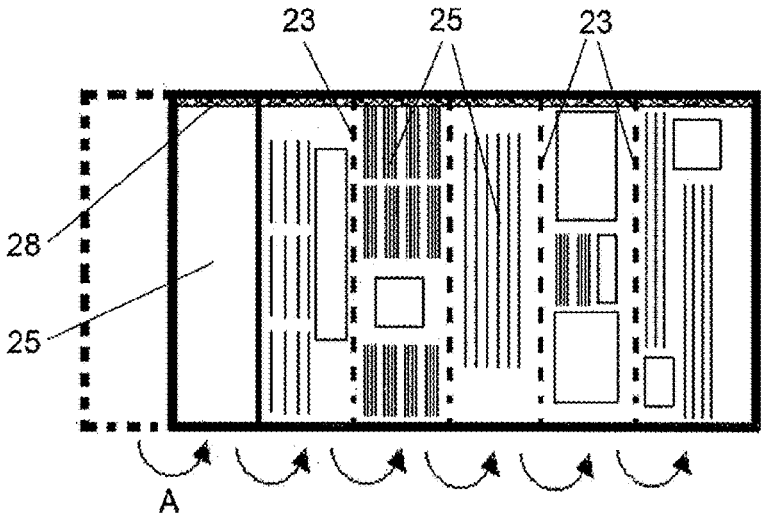
Figure 5:
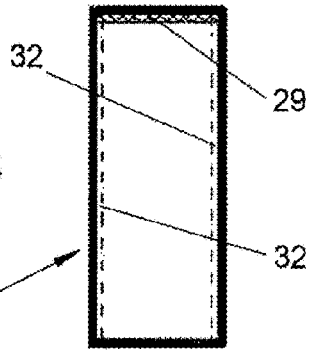

The sheet, subsequently, transits in the station of folding and cutting 16 where it is folded and cut, as schematised in FIGS. 4 and 5.

More particularly the sheet 26 is folded on itself along the imaginary lines 23 (transversal with respect to the direction of longitudinal development of the single sheet 26 and therefore with respect to said zone 28 of the edge of the sheet provided with glue) in a direction indicated by the arrow A (FIG. 4) starting from a wing 25 defining a single page positioned at one end of the single sheet 26 and in the direction of the opposite end in such a way that said wing is superimposed on the successive and adjacent wing to define a folded sheet 30 (FIG. 5) in which, through the effect of the folding, the zone of gluing 28 is placed at the short side of the folded sheet 30, and maintains integral said single pages.

Figure 6:
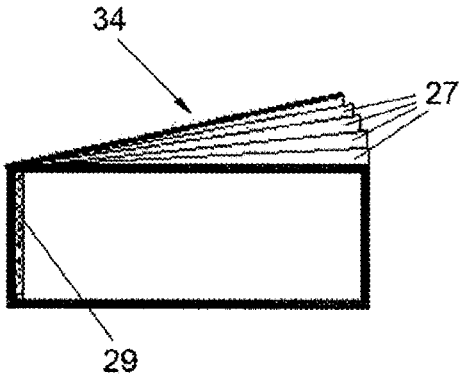
FIG. 6 shows schematically an axonometric view of the multipage information leaflet obtained with the apparatus operating in accordance with the method.

The folded sheet 30 is, subsequently, subjected to a cutting process performed along further imaginary lines of cutting 32 (FIG. 5) at opposite edges of the long side, i.e. of said opposite transversal edge portions of said folded sheet 30 to define a multipage information leaflet 34 comprising the two or more pages 27 integral one with the other at a joining area 29 defined by the band provided with glue 28, as schematised in FIG. 6: in this way the information leaflet can be browsed.

The information leaflet 34 formed in this way passes, subsequently, in the transit and transfer station 18, placed in succession to the folding and cutting station, for a movement, by means of rollers or in another known and equivalent manner, in the direction of the pressing station 20 where the joining area 29 defined by the gluing band 28 is pressed (for example by means of rollers) in order to avoid the formation of humps or irregularities which can jeopardise the good quality of the finished product.

The multipage information leaflet 34 can subsequently be stacked in reams and stored in the warehouse or moved in further production lines where it is subjected to folding operations and insertion in a container of a specific product whereto said leaflet is associated.

As can be seen from the above, the advantages that the process and the apparatus of the invention achieve are clear.

The process for the production of information leaflets of the present invention allows, advantageously, the production of information leaflets or slips with multiple pages (two or more) starting from a single sheet printed on one or on both the sides so as to avoid disadvantages linked to the presence of blank pages or of pages not corresponding to the product with which said information leaflet has to be enclosed.

A further advantage is represented by the fact that the process of the invention, starting from a single sheet subsequently glued, folded and cut, allows the times of the production cycle to be reduced with a consequent advantage in terms of production costs.

A further advantage is represented by the fact that the working stations of the apparatus of the invention are flexible and can be reconfigured so as to be able to manage the production of information leaflets or slips with different formats.

Although the invention has been described above with particular reference to one of its embodiments given solely by way of a non-limiting example, numerous changes and variations will appear clear to a person skilled in the art in light of the description given above. The present invention intends, therefore, to embrace all the modifications and the variations that fall within the scope of the following claims.

The invention claimed is:

1. A process for the production of multipage leaflets where said leaflet has a booklet structure and comprises two or more pages, the process comprising in sequence:

loading and feeding a ream of sheets;

taking a single sheet from the ream and applying glue along an edge portion of said single sheet;

multiple folding of the single sheet along parallel lines of folding that are transversal to the edge portion provided with glue of the single sheet, to create a folded sheet;

cutting the folded sheet along opposite transversal edge portions formed by the folding step to create a multipage leaflet with the pages connected one to the other only at a joining area defined by the area provided with glue near an edge;

pressing the joining area; and storing and collecting finished leaflets.

2. The process according to claim 1, wherein the gluing is performed hot or cold by applying at least one strip of glue along one edge of a side of said single sheet to create a glue band.

3. The process according to claim 2, wherein the multiple folding of the single sheet is carried out by folding a wing of the single sheet on a successive and adjacent wing, in a direction perpendicular to the glue band and starting from an end of said single sheet in a direction of an opposite end of the single sheet so that edges of said wings at the glue band are integral one with each other.

4. The process according to claim 3, wherein the cutting of the folded sheet is carried out along opposite imaginary lines at opposite edges of said folded sheet perpendicularly oriented with respect to the joining area defined by the glue band.

5. The process according to claim 2, wherein the cutting of the folded sheet is carried out along opposite imaginary lines at opposite edges of said folded sheet perpendicularly oriented with respect to the joining area defined by the glue band.

6. An apparatus for carrying out the process in accordance with claim 2, for the production of leaflets or slips, comprising the following working stations in sequence:

a loading and feeding station comprising a sheet feeder device configured to take a single sheet from a block or ream of sheets loaded onto said station and having a pneumatic head for lifting a single sheet at a time and a drum to drive a single sheet in a direction of a next working station;

a gluing station comprising a gluing head configured to deposit or spray, hot or cold, small drops of glue or a strip of glue along an edge of a side of a single sheet so as to define a glue band;

a folding and cutting station configured to multiple fold a single sheet along lines of folding which are parallel one to the other and transversal to a portion provided with glue, to create a folded sheet, said folding and cutting station being further configured to cut a folded sheet along opposite transversal edge portions to create a multipage leaflet with pages connected one to the other only at a joining area defined by an area provided with glue near an edge;

a transfer station;

a pressing station configured to press a joining area of a folded sheet; and a finished products accumulation station configured to collect and store finished leaflets.

7. The process according to claim 1, wherein the gluing is performed hot or cold by applying small drops of glue along one edge of a side of said single sheet to create a glue band.

8. The process according to claim 7, wherein the small drops of glue are applied by spraying.

9. An apparatus for the production of leaflets or slips, comprising in sequence the following working stations:

a loading and feeding station comprising a sheet feeder device configured to take a single sheet from a block or ream of sheets loaded onto said station and having a pneumatic head for lifting a single sheet at a time and a drum to drive a single sheet in a direction of a next working station;

a gluing station comprising a gluing head configured to apply glue along an edge of a side of a single sheet so as to define a glue band;

a folding and cutting station configured to multiple fold a single sheet along lines of folding which are parallel one to the other and transversal to a portion provided with glue, to create a folded sheet, said folding and cutting station being further configured to cut a folded sheet along opposite transversal edge portions to create a multipage leaflet with pages connected one to the other only at a joining area defined by an area provided with glue near an edge;

a transfer station;

a pressing station configured to press a joining area of a folded sheet; and a finished products accumulation station configured to collect and store finished leaflets.

10. The apparatus according to claim 9, further comprising:

a compaction station configured to compact groups of finished leaflets coming from the accumulation station and configured to divide finished leaflets into reams of leaflets.

11. The apparatus according to claim 10, further comprising:

a control unit that controls and manages sequential and synchronized functioning of the working stations on a basis of signals coming from sensors of said working stations.

12. The apparatus according to claim 9, further comprising:

a control unit that controls and manages sequential and synchronized functioning of the working stations on a basis of signals coming from sensors of said working stations.

13. A folded sheet for use in a process of producing a multipage leaflet, comprising:

a single sheet comprising an edge portion provided with glue, wherein said single sheet is multiple folded on itself along lines of folding which are parallel one to the other and transversal to the edge portion provided with glue to create said folded sheet, whereby said folded sheet is configured to be cut along the lines of folding to create a multipage leaflet with pages connected one to the other only at a joining area defined by the edge portion provided with glue.

14. An apparatus for the production of leaflets or slips, comprising the following working stations in sequence:

a loading and feeding station comprising a sheet feeder device configured to take a single sheet from a block or ream of sheets loaded onto said station and having a pneumatic head for lifting a single sheet at a time and a drum to drive a single sheet in a direction of a next working station;

a gluing station comprising a gluing head configured to apply at least one strip of glue along an edge of a side of a single sheet so as to define a glue band;

a folding and cutting station configured to multiple fold a single sheet along lines of folding which are parallel one to the other and transversal to a portion provided with glue, to create a folded sheet, said folding and cutting station being further configured to cut a folded sheet along opposite transversal edge portions to create a multipage leaflet with pages connected one to the other only at a joining area defined by an area provided with glue near an edge;

a transfer station;

a pressing station configured to press a joining area of a folded sheet; and a finished products accumulation station configured to collect and store finished leaflets.

15. An apparatus for the production of leaflets or slips, comprising the following working stations in sequence:

a loading and feeding station comprising a sheet feeder device configured to take a single sheet from a block or ream of sheets loaded onto said station and having a pneumatic head for lifting a single sheet at a time and a drum to drive a single sheet in a direction of a next working station;

a gluing station comprising a gluing head configured to spray drops of glue along an edge of a side of a single sheet so as to define a glue band;

a folding and cutting station configured to multiple fold a single sheet along lines of folding which are parallel one to the other and transversal to a portion provided with glue, to create a folded sheet, said folding and cutting station being further configured to cut a folded sheet along opposite transversal edge portions to create a multipage leaflet with pages connected one to the other only at a joining area defined by an area provided with glue near an edge;

a transfer station;

a pressing station configured to press a joining area of a folded sheet; and a finished products accumulation station configured to collect and store finished leaflets.

* * * * *